United States Patent [19]

Swanson

[11] Patent Number: 4,718,569

[45] Date of Patent: Jan. 12, 1988

[54] LOCKING SYSTEM FOR GAS CYLINDERS

[76] Inventor: John F. Swanson, 11 Battle Park Dr., Spotsylvania, Va. 22553

[21] Appl. No.: 916,100

[22] Filed: Oct. 7, 1986

[51] Int. Cl.[4] ..... B65D 85/20; B65D 81/24

[52] U.S. Cl. ..... 220/212; 220/315; 220/85 R

[58] Field of Search ..... 220/85 R, 200, 212, 220/255, 252, 315

[56] References Cited

U.S. PATENT DOCUMENTS

| | | | |
|---|---|---|---|
| 414,702 | 11/1889 | Grimm | 220/255 |
| 1,196,630 | 8/1916 | Zimmerman | 220/255 |
| 2,927,713 | 3/1960 | Buttery et al. | 220/85 R |
| 3,688,943 | 9/1972 | Brown | 220/85 R |
| 4,412,616 | 11/1983 | Williams | 220/255 |

*Primary Examiner*—Joseph Man-Fu Moy

*Attorney, Agent, or Firm*—Cushman, Darby & Cushman

[57] ABSTRACT

A lockable gas cylinder cap system comprised of hinged upper and lower cap portions and a lockable equipment or parts holding box removably attached to the lower cap portion by a T-shaped connecting member that is slidably received in a downwardly extending slot provided in edge and sidewall of the lower cap portion. The box is provided with a hingably secured lid that includes an outwardly extending locking tab member that overlies the T-shaped connection when the lid is closed so as to be retained between the upper and lower portions of the cap when they are closed together.

5 Claims, 11 Drawing Figures

LOCKING SYSTEM FOR GAS CYLINDERS

FIELD OF THE INVENTION

The preseht invention relates to an improved gas cylinder locking cap and a removable equipment or parts holder assembly that is lockable therewith once in place and the cap itself is locked.

BACKGROUND OF THE PRESENT INVENTION

When dealing with gas cylinders of various types, in particular oxygen, acetylene, or other types of bottled gas, it is desirable to include the necessary hoses, gauges or other pieces of equipment needed when using such cylinders and valving for controlling gas flow and to provide access to such equipment at a convenient place. To the extent that such hoses, gauges or other peripheral equipment can be stored directly with the gas container, then time can be saved when assembling the equipment necessary to operate or set up gas cylinders for operation. Also, storage problems will be reduced or minimized if this peripheral equipment is retained with the gas cylinders and the detachable box will help assure the ready availability of such equipment. It is also desirable that the cylinder locking caps be used either with or without such an equipment holding box, as when the gas containers were merely being shipped or in storage.

FIGS. 1 and 2, show a system for holding gauges, hoses or couplings which was used experimentally in the development of the present invention. The gas cylinder cap is comprised of an upper portion 10 and a lower portion 12, connected together by a hinge 14. The equipment box 16$\mu$ was comprised of a lower portion 18 welded along a line indicated at 20 so as to become an integral part of the lower portion of the cap. The box also included a separate lid 22 which was welded to the upper portion 10 of the cap as indicated at 24. The front edge of lid 22 was provided with an opening, generally indicated at 26, through which an upstanding finger 28, mounted to the front of the lower portion of the box extended when the lid was in its closed position, which only occured when the upper portion of the cap was in its closed position. Finger 28 was provided with an aperture 30. Thus, the upper portion 10 of the cap and lid 22 would move as an integral unit and when closed, finger 28 would extend through opening 26 positioning opening 30 above the closed lid. A lock could then be placed through aperture 30 thereby locking the upper and lower portions of the cap and the lid to the lower portion of the box. Thus, the lower portion of the box and the bottom portion of the cap on one hand and the upper portion of a cap and the lid on the other constituted separate, integral elements. However, the box was not removable and would not permit either a change in box type nor use of only the cap elements.

A different type of locking system for a valve is shown in Wrenshall U.S. Pat. No. 3,391,554 wherein a dome shaped cylinder cover was provided with a centrally postioned aperture at the top of the dome through which a separate locking finger extended to allow the cover to be locked in place.

Similar types of locking cap arrangements where two members are brought together or where a tongue is allowed to penetrate through an opening with a locking-aperture being provided in the tongue and which is exposed of locking purposes are shown in Grady et al U.S. Pat. No. 1,947,081, Quarfoot U.S. Pat. No. 2,377,036 and Boak U.S. Pat. No. 3,240,407.

Johnson U.S. Pat. No. 2,291,811 shows a tank supporting device wherein a bracket mounted to a wall can secure and hold a tank of gas with a portion of the support structure extending through the sidewall of the tank's upper structure. When a cover is placed over the upper tank structure, a depending mechanism within the cover interfits with the support structure extending into the tank's sidewall so that when the cover locked in placed the tank is simultaneously locked to the support structure.

Other locking systems are shown in Lewy U.S. Pat. No. 674,582 Ooubble U.S. Pat. No. 2,462,951, Obenchain U.S. Pat. No. 2,635,939, Lehto U.S. Pat. No. 3,399,553, and Buikus U.S. Pat. No. 3,930,389.

SUMMARY OF THE PRESENT INVENTION

The present invention concerns a modified gas cylinder locking cap arrangement as well as a removable, clip-on equipment box that can be readily positioned on or removed from the cap assembly. When in place, it can be locked by the cap sections when they are locked, but is otherwise removable from the cap structure.

The gas cylinder cap assembly is comprised of upper and lower portions that are hinged together with each containing means for cooperating to permit those sections to be locked together. The lower portion includes an upper edge and a slot which depends downwardly away from that edge on one side thereof. That, slot can either depend at an angle of about 30° to 45° from vertical or at any other angle convenient to the configuration of the lower member and the box.

The box assembly includes an upwardly open lower portion including integral bottom and sidewalls. This box can have any desire shaped, preferably either square or rectangular in plan section and either L-shaped or rectangular in its cross-sectional shape, with a hinge along one side for hingeably securing a lid which will cover and completely close the box. A T-shaped member is attached to the lower portion on the sidewall opposite that to which the hinge is mounted. That T-shaped member is designed to interfit with the slot provided in the lower portion of a cap and to securely yet removably hold the box in place on the cap. The lid is provided with an outwardly extending tabe member positioned so as to overlie the T-shaped member when the lid is closed. Such an outwardly extending tab member will also fit between the upper and lower portions of the cap when closed and the box is in place and the lid previously closed. In that condition, the outwardly extending member or tab will be retained between the cap portions thereby securing the lid in a closed condition. That outwardly extending tab member can have its distal end bent either upwardly and downwardly to more positively assure the locking feature of the present invention.

Other objects, features, and characteristics of the present invention, as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EXEMPLARY EMBODIMENT OF THE PRESENT INVENTION

Figure 1:
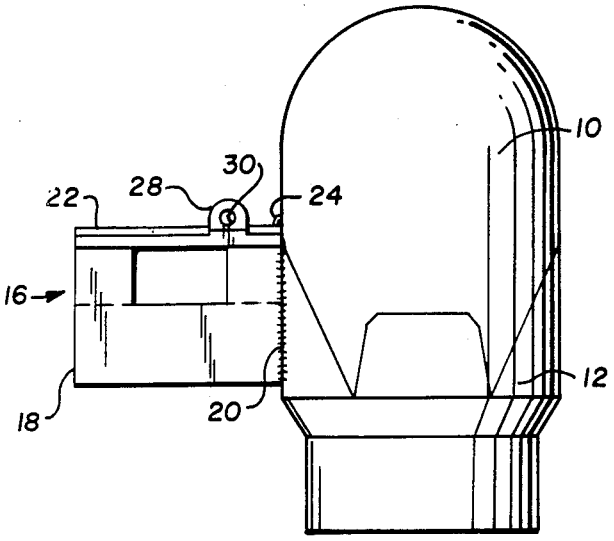
Fig. 1 (PRIOR ART)
FIG. 1 is a front elevational view of an experimental design locking cylinder cap system.
Figure 2:
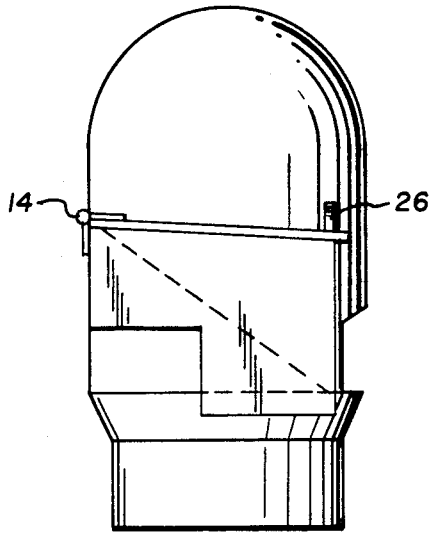
Fig. 2 (PRIOR ART)
FIG. 2 is a elevational view from the left side of the structure shown in FIG. 1.
Figure 3:
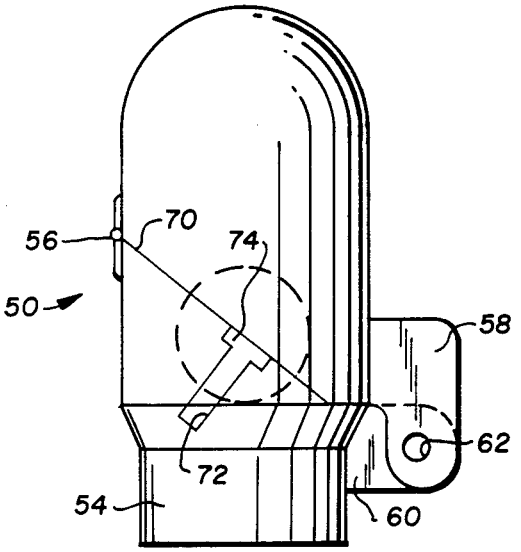
FIG. 3 shows an elevational view of the gas cylinder cap assembly according to the present invention without the holding box attached.
Figure 4:
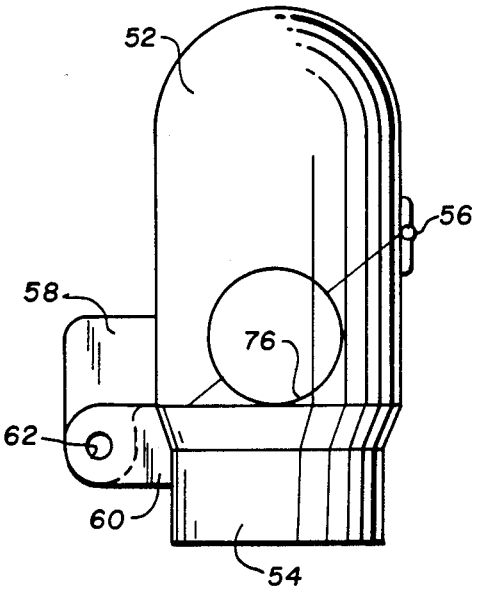
FIG. 4 is a view of the opposite side of the gas cap assembly shown in FIG. 3.
Figure 5:
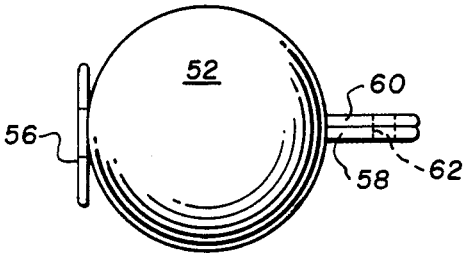
FIG. 5 is a top plan view of the cap shown in FIG. 3.

Turning to FIGS. 3–5, the gas cylinder cap assembly is generally indicated at 50 and is comprised of a top cap portion 52, bottom cap portion 54 and a joining hinge 56.

Top portion 52 includes an outwardly extending locking tab or projection 58 as shown best in FIG. 5. Bottom portion 54 also includes locking tab 60 that will cooperate and interfit with tab 58 when the two portions are closed. Each tab 58 and 60 includes an aperture that will lie adjacent one another and be aligned when the cap portions are closed, as shown in FIGS. 3–5. Such apertures define an aligned locking aperture 62 through which any suitable locking mechanism can be used.

The botton cap portion 54 includes an upper edge 70 from which a substantially rectangular shaped, depending slot 72 extends in a downwardly direction away from edge 70. As shown, slot 72 can also include an enlarged upper portion, indicated at 74, although this is not required. The mating edge of upper portion 52 has not been modified but will simply close over the opening defined by slot 70. As shown on the right side of the cap assembly in FIG. 4, a generally circular aperture 76 can be also be provided for receiving or closing over portions of the valve or hose assembly.

Figure 6:
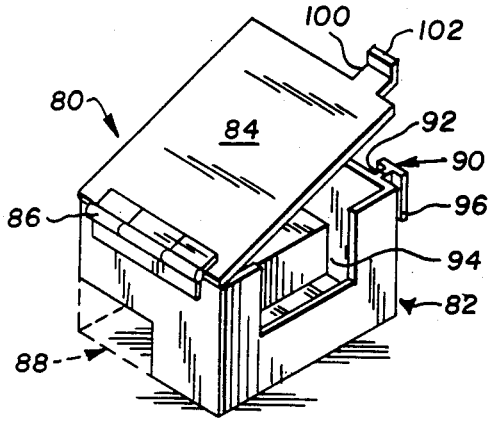
FIG. 6 is an isometric view of the holding box with the lid partially open.
Figure 7:
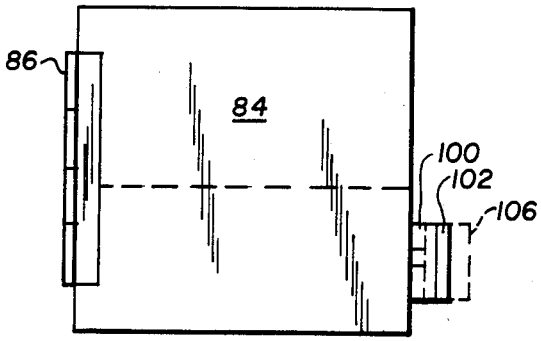
FIG. 7 is a top plan view of the box shown in FIG. 6.
Figure 8:
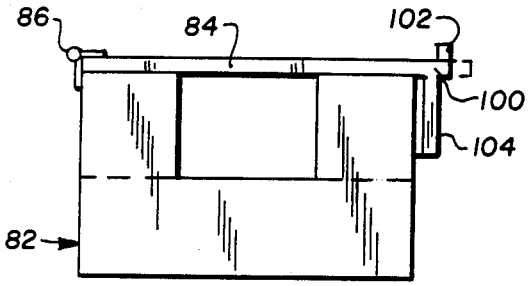
FIG. 8 is a view of the front side of the box shown in FIG. 7.

Turning now to FIG. 6, the equipment holding box assembly is generally indicated at 80 and is comprised of a lower box portion 82, a lid 84, and a joining hinge 86. Box 80 can have a variety of various L-shaped lower portions, such as a generally L-shaped structure shown in FIG. 6 or the box could be rectangular, as indicated by the dotted lines at 88. Further, the box shape can be coordinated to suitably receive the equipment or parts that are desirably used and various shapes are contemplated herein. In fact, the box shape may vary depending on the type of gas or valving arrangement to be used.

A T-shaped mounting member 90 is provided on lower portion 82 and specifically on the side of the box located opposite to the side on where hinge 86 is mounted. T-shaped member 90 is comprised of a flange 92 which is welded or otherwise fixed to the box so as to extend outwardly from and substantially perpendicular to side wall 94. A second member 96 is welded or otherwise fixed to the outer end of flange 92 so as to extend substantially parallel to side wall 94. Flange 92 should have a length at least as great as the thickness of the walls forming the bottom cap portion 54 and in any event of a length sufficient to permit member 96 to be received interiorly of bottom portion 54 when box 80 is mounted in place.

Figure 9:
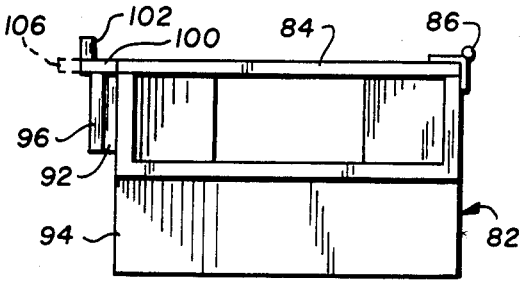
FIG. 9 is a view of the back side of the box shown in FIG. 7.
Figure 10:
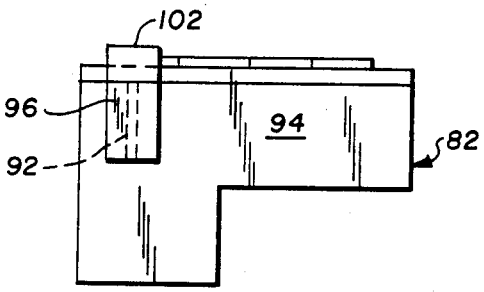
FIG. 10 is a view of the right hand side of the box looking directly at the mounting assembly.
Figure 11:
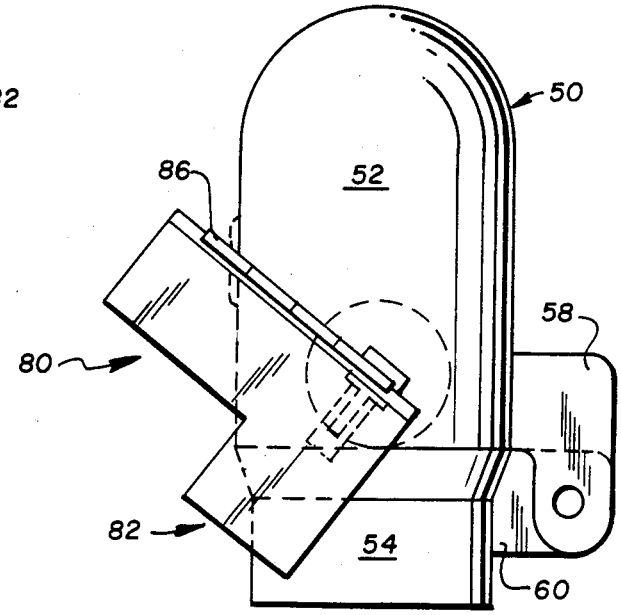
FIG. 11 is a side elevational view of the gas cylinder cap assembly shown in FIG. 3 together with the holding box shown in FIGS. 6–10 mounted in place.

Lid 84 is provided with an outwardly extending tab member 100, the end of which can be turned, as indicated at 102, so that an L-shaped flanged is formed. The turned portion could also be directed either upwardly or downwardly as at 104 so as to overlie plate 96 of the T-shaped member 90. Alternatively, the end of member 100 could remain straight as indicated in phantom at 106 in FIG. 9 What is important is that a portion of tab member 100 overlie T shaped member 90 so as to be engaged by the edge of upper cap portion 52 when closed.

In operation, with the upper portion 52 of the gas cap open, box assembly 80 is positioned so that member 90 slides downwardly within slot 72 with plate 96 positioned interiorly of slot 72 and inside the lower portion of cap 54. In order to open lid 84 it will be necessary first to unlock the upper and bottom portions 52 and 54 of the cap assembly 50, assuming they had been locked, and to open the upper portion 52. This will release tab member 100 and lid 84 will then be pivotable to its open position via hinge 86. The entire box would also be removable with the top of the cap in its open position. To close and lock the box and cap assembly these steps are reversed.

The cap and box structures can be formed from like or differing materials, which materials include metals such as steels, aluminum, or thermoset a thermoplastic resin. Also, it is contemplated that the separate pieces could be molded by injection molding or other conventional molding techniques. Further, the dimensions can vary to suit particular gas cylinders.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A removable and lockable box for cooperating with a gas cylinder cap assembly, said gas cylinder cap assembly having upper and lower portions hingedly connected together and means for locking the upper and lower portions together, said lower portion having an upper edge and means defining a slot extending downwardly away from said upper edge, said box having a lower body portion and a lid hingeably attached thereto on one side of the lower body portion, said lower body portion having an outwardly directed T-shaped mounting member positioned on a side of said lower body portion opposite said one side, said lid including an outwardly directed tab member positioned so as to overlie said T-shaped flange when said lid is closed over said lower body portion so that when said T-shaped mounting member is positioned within said slot means said box will be retained on said cap and when said lid is closed and the upper portion of the cap is closed and locked thereover said lid will be simultaneously locked in a closed position.

2. The structures set forth in claim 1 wherein said lower body has an L-shaped cross-section.

3. The structure in claim 1 wherein the cap and box are comprised of molded components.

4. The structure as in claim 1 wherein the cap and box are comprised of metal.

5. The structure as in claim 1 wherein said top member is formed as an L-shaped member.

* * * * *